US006742733B2

(12) United States Patent
Huang

(10) Patent No.: US 6,742,733 B2
(45) Date of Patent: Jun. 1, 2004

(54) DISK DATA DESTROYER

(76) Inventor: Li-Ming Wu Huang, 3F, No. 29, Lane 80, Sec. 1, Dwu Hwu S. Rd., Taipei (TW)

( * ) Notice: Subject to any disclaimer, the term of this patent is extended or adjusted under 35 U.S.C. 154(b) by 79 days.

(21) Appl. No.: 10/079,618

(22) Filed: Feb. 22, 2002

(65) Prior Publication Data

US 2003/0160119 A1 Aug. 28, 2003

(51) Int. Cl.[7] ..... B02C 18/22

(52) U.S. Cl. ..... 241/36; 241/100; 241/222; 241/235

(58) Field of Search ..... 241/34, 36, 100, 241/236, 222, 235, 234, 296, 297

(56) References Cited

U.S. PATENT DOCUMENTS 5,511,732 A * 4/1996 Kroger et al. ..... 241/166
5,961,059 A * 10/1999 Kroger ..... 241/236
6,390,397 B1 * 5/2002 Ko ..... 241/34
6,550,701 B1 * 4/2003 Chang ..... 241/36
2003/0006330 A1 * 1/2003 Change ..... 241/236

* cited by examiner

*Primary Examiner*—Allen Ostrager
*Assistant Examiner*—Shelley Self
(74) *Attorney, Agent, or Firm*—Browdy and Neimark, P.L.L.C.

(57) ABSTRACT

A disk data destroyer comprises a housing, a data destroying shaft set, a motor driver and a sensor. The housing is provided with a hollow receiving chamber, a disk insertion slot and a disk outlet opposite said insertion slot. The sensor is mounted inside said housing adjacent to said disk insertion slot and adapted to output a driving signal to start said motor driver to drive the data destroying shaft set to rotate upon insertion of a data storage disk into said disk insertion slot such that the inserted disk is pressed by the data destroying shaft set so as to destroy storage data thereof.

5 Claims, 5 Drawing Sheets

DISK DATA DESTROYER

FIELD OF THE INVENTION

The present invention relates to an office machine and, more specifically, to a disk data destroyer.

BACKGROUND OF THE INVENTION

In order to prevent improper use of office confidential documents by people who are not authorized to use the documents, every company may employ much money and labor to destroy confidential documents not in use. Nowadays, data storage disks are commonly used as data storage media for storing data. When destroying the storage data of data storage disks, people usually use scissors to cut the disks into pieces. However, the cut pieces of disk parts may still readable. In order to completely destroy the storage data, the disks must be cut into very small pieces. It takes much time to cut the disks into very small pieces.

SUMMARY OF THE INVENTION

It is the main object of the present invention to provide a disk data destroyer, which effectively permanently destroys the storage data of data storage disks.

It is another object of the present invention to provide a disk data destroyer, which is easy to operate.

To achieve these objects of the present invention, the disk data destroyer comprises a housing, a data destroying shaft set, a motor driver and a sensor. The housing is provided with a hollow receiving chamber, a disk insertion slot and a disk outlet opposite said insertion slot. The sensor is mounted inside said housing adjacent to said disk insertion slot and adapted to output a driving signal to start said motor driver to drive the data destroying shaft set to rotate upon insertion of a data storage disk into said disk insertion slot such that the inserted disk is pressed by the data destroying shaft set so as to destroy storage data thereof.

DETAILED DESCRIPTION OF THE INVENTION

Figure 1:
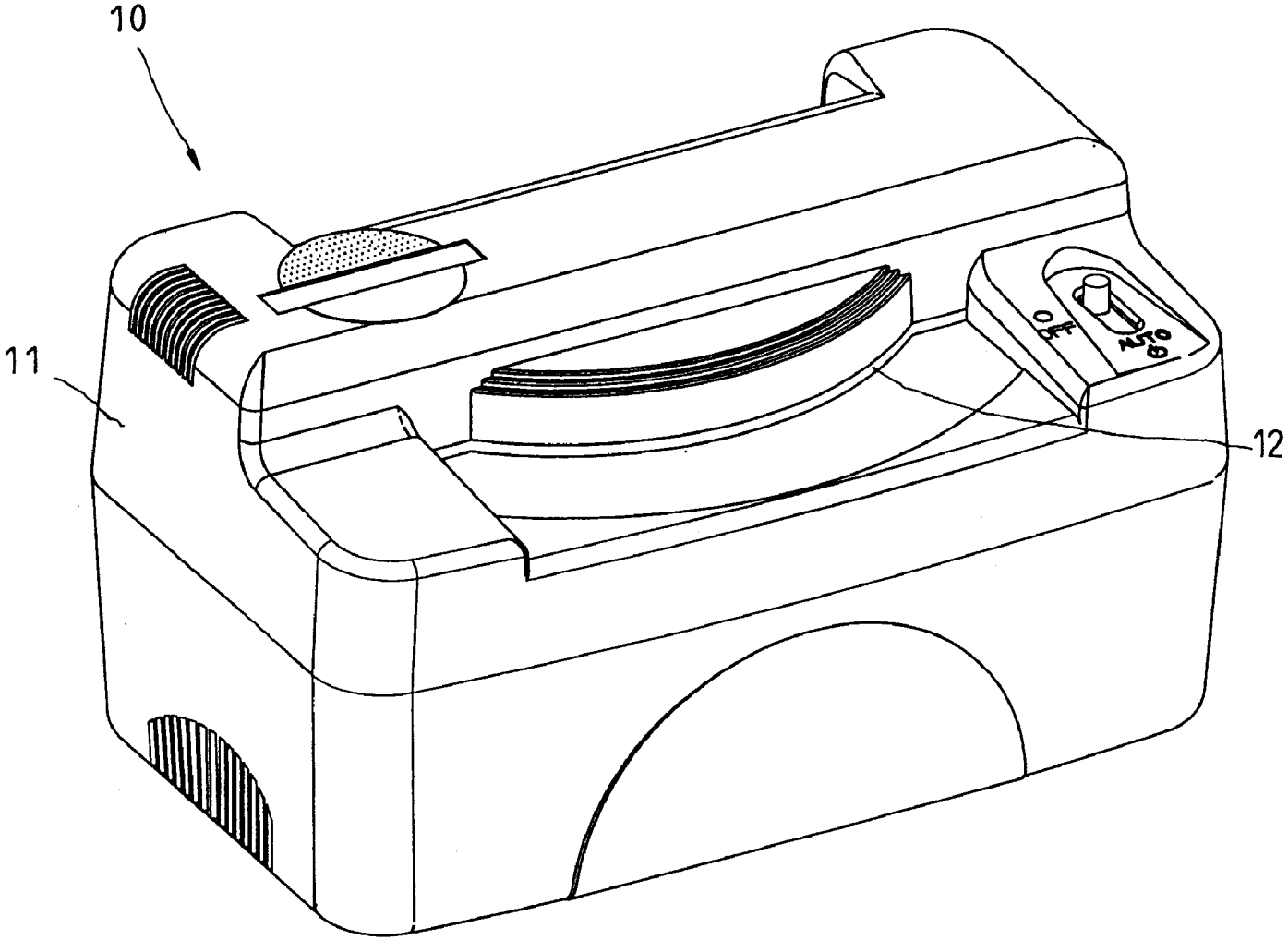
FIG. 1 is a perspective view of a disk data destroyer according to a preferred embodiment of the present invention.
Figure 2:
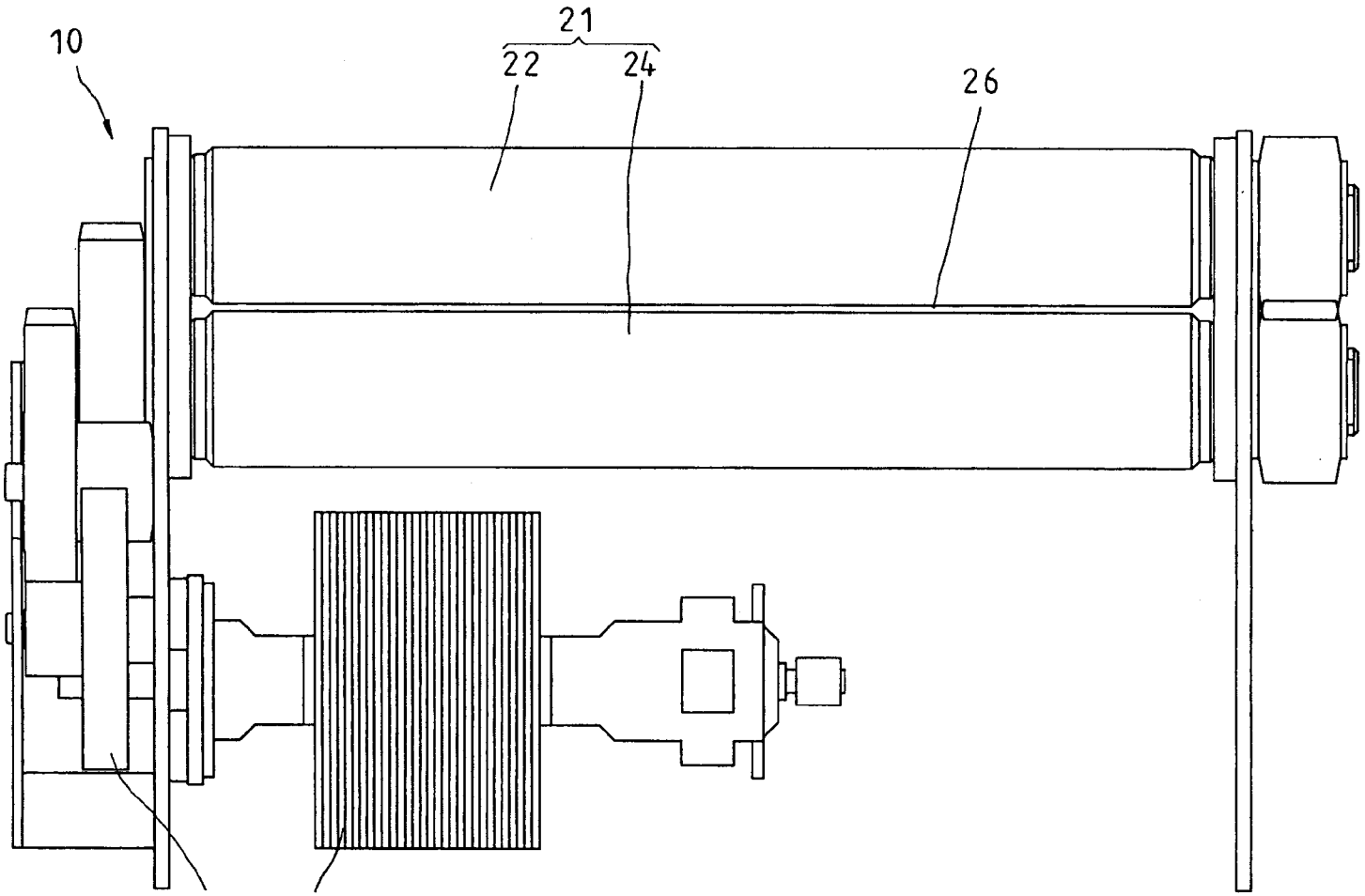
FIG. 2 is a front view of the preferred embodiment of the present invention, showing the internal arrangement of the disk data destroyer after opening of the housing.
Figure 3:
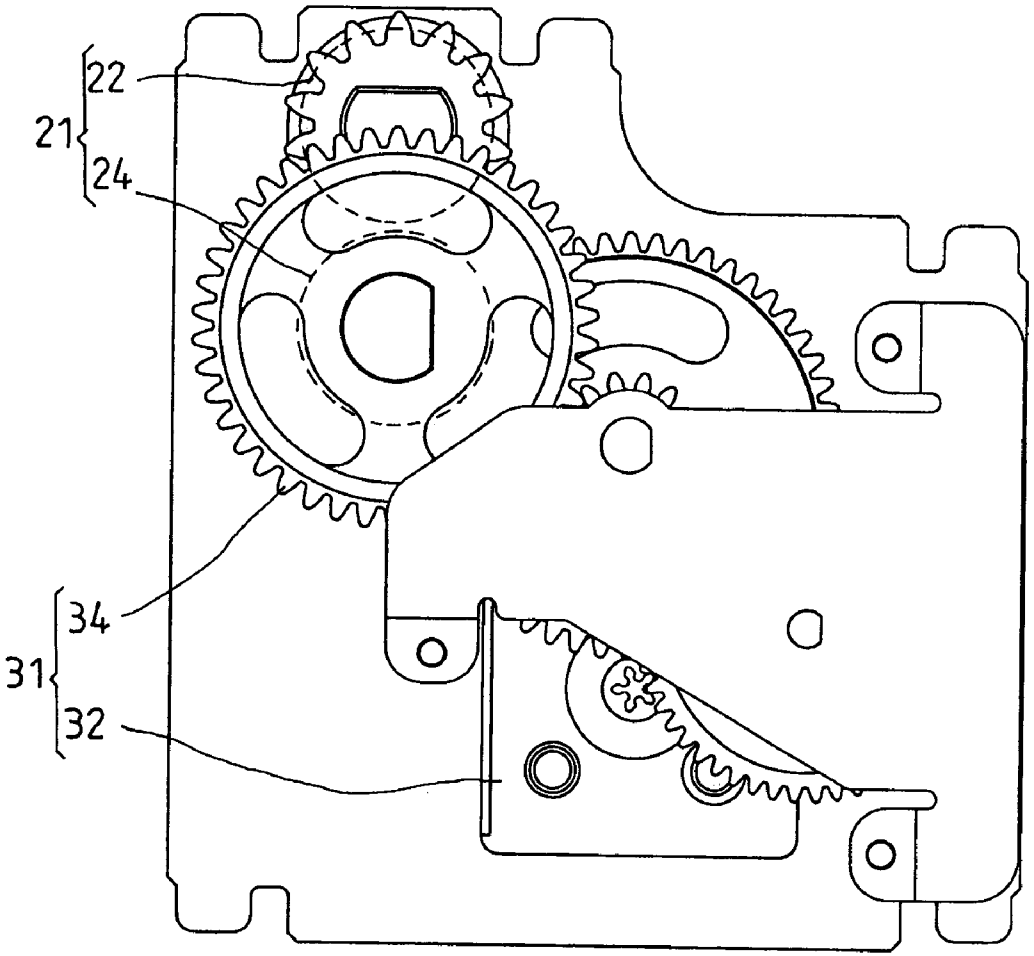
FIG. 3 is a left side view of the preferred embodiment of the present invention, showing the internal arrangement of the disk data destroyer after opening of the housing.

Referring to FIGS. from 1 through 4, a disk data destroyer 10 of a preferred embodiment of the present invention is shown comprised of a housing 11, a data destroying shaft set 21, a motor driver 31, and a sensor 41.

The housing 11 is a hollow rectangular case defining an inside receiving chamber, having a disk insertion slot 12 in the front side through which a data storage disk 20 is inserted into the housing 11 for destroying the storage data, and a disk outlet 14 in the back side through which the inserted data storage disk 20 passes out of the housing 11.

The data destroying shaft set 21 is mounted in the inside receiving chamber of the housing 11, comprising an upper embossed shaft 22 and a lower embossed shaft 24. The upper embossed shaft 22 and the lower embossed shaft 24 are arranged in parallel with a gap 26 left therebetween. The pitch of the gap 26 is slightly smaller than the thickness of the data storage disk 20.

The motor driver 31 is comprised of a motor 32, and a transmission gear set 34. The motor 32 is mounted in the inside receiving chamber of the housing 11 below the data destroying shaft set 21. The transmission gear set 34 is coupled between the motor 32 and the data destroying shaft set 21. When starting the motor 32, the transmission gear set 34 is driven to rotate the upper embossed shaft 22 and the lower embossed shaft 24 in reversed directions.

The sensor 41 is mounted inside the housing 11 adjacent to the disk insertion slot 12. The sensor 41 can be a micro-switch or LED electric eye. When a data storage disk inserted into the disk insertion slot 12, the sensor 41 is triggered (in case of a micro-switch) or induced (in case of a LED electric eye) to output a signal to the motor driver 31, causing the motor driver 31 to work.

Figure 4:
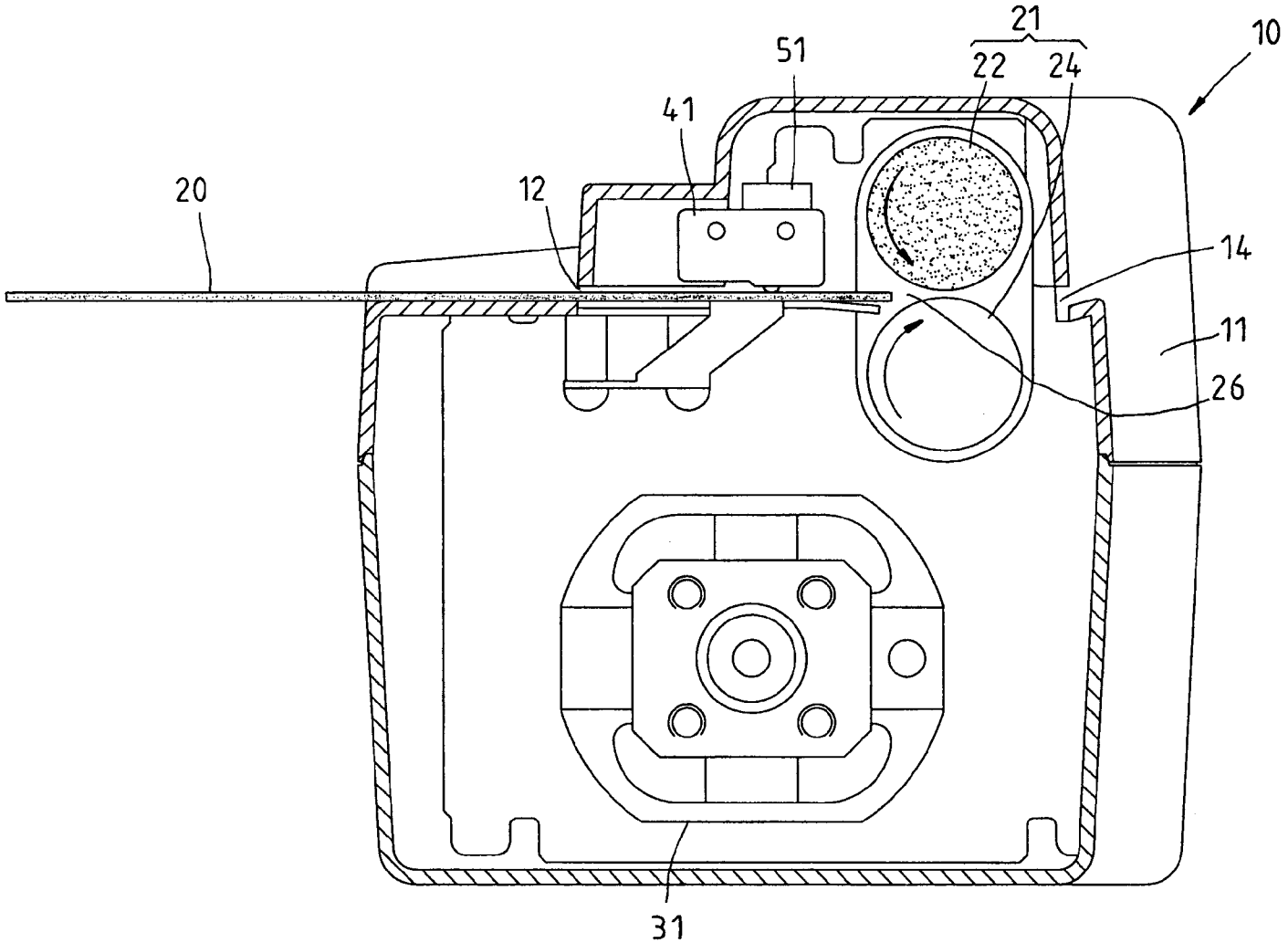
FIG. 4 is a schematic drawing showing an operation status of the disk data destroyer according to the preferred embodiment of the present invention.

Referring to FIG. 4, when a data storage disk 20 inserted into the disk insertion slot 12, the sensor 41 is activated to output a signal to the motor driver 31, thereby causing the motor 32 to be started, and therefore the transmission gear set 34 is driven to rotate the upper embossed shaft 22 and the lower embossed shaft 24 in reversed directions. During reverse rotation of the upper embossed shaft 22 and the lower embossed shaft 24, the inserted data storage disk 20 is carried forwards from the disk insertion slot 12 through the gap 26 in between the upper embossed shaft 22 and the lower embossed shaft 24 toward the disk outlet 14. When passing through the gap 26 in between the embossed shaft 22 and the embossed shaft 24, the surface of the inserted data storage disk 20 is embossed, and therefore the storage data of the inserted data storage disk 20 is permanently destroyed.

Further, if the sensor 41 is off immediately after the rear end edge of the inserted data storage disk 20 passed over the sensor 41, the motor driver 31 will be turned off before the delivery of the inserted data storage disk 20 to the disk outlet 14. In order to eliminate this problem, a time delay circuit 51 is installed in the housing 11 and electrically connected to the sensor 41, for enabling the motor driver 31 to keep working for about 2~3 seconds after the rear end edge of the inserted data storage disk 20 passed over the sensor 41, and therefore, the inserted data storage disk 20 can be delivered out of the disk outlet 14.

Figure 5:
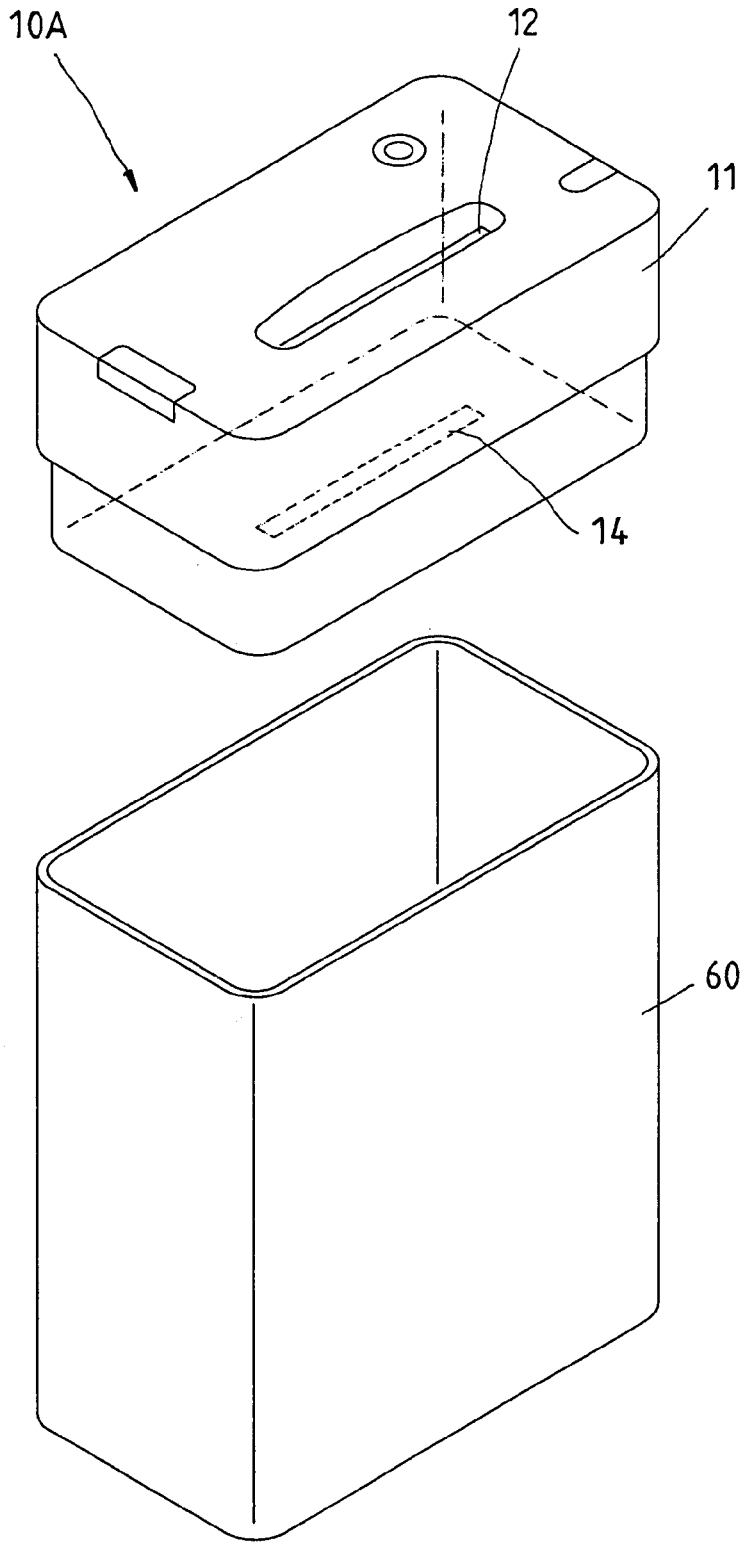
FIG. 5 shows an alternate form of the disk data destroyer according to another preferred embodiment of the present invention.

FIG. 5 shows an alternate form of the disk data destroyer. According to this alternate form, the disk insertion slot 12 and the disk outlet 12 of the disk data destroyer 10A are respectively disposed in the top and bottom sides of the housing 11, and a container 60 is provided at the bottom side of the housing 11 to collect destroyed disks.

As indicated above, the present invention provides a disk data destroyer, which achieves the following advantages:

1. Effective disk data destruction: The embossing effect of the upper embossed shaft and the lower embossed shaft permanently destroy the storage data of the inserted data storage disk.

2. Ease of operation: Because the disk data destroyer is of an automatic design, the user can use the apparatus easily without through a learning course.

What is claimed is:

1. A disk data destroyer comprising:

a housing provided at the inside thereof with a hollow receiving chamber, said housing having a disk insertion slot and a disk outlet opposite said disk insertion slot;

a data destroying shaft set provided with two embossed shafts arranged in parallel in the hollow receiving chamber inside said housing wherein a gap is formed between said two embossed shafts, and the gap is smaller than the thickness of the data storage disks to be destroyed;

a motor driver mounted in the hollow receiving chamber inside said housing, said motor driver having a motor and a transmission gear set coupled between said motor and said two embossed shafts and adapted to rotate said two embossed shafts;

a sensor mounted inside said housing adjacent to said disk insertion slot and adapted to output a driving signal to start said motor upon insertion of a data storage disk into said disk insertion slot, and a time delay circuit disposed adjacent to said sensor and adapted for enabling said motor driver to keep working for about 2~3 seconds after an inserted data storage disk passed over said sensor.

2. The disk data destroyer as claimed in claim 1, wherein said sensor is comprised of a micro-switch.

3. The disk data destroyer as claimed in claim 1, wherein said sensor is comprised of an LED (light emitting diode) electric eye.

4. The disk data destroyer as claimed in claim 1, wherein said transmission gear set is adapted to rotate said two embossed shafts in reversed directions.

5. The disk data destroyer as claimed in claim 1, further comprising a container adapted to collect destroyed data storage disks from the disk outlet of said housing.

* * * * *